US006655284B1

(12) United States Patent
Hoshii et al.

(10) Patent No.: US 6,655,284 B1
(45) Date of Patent: Dec. 2, 2003

(54) CUSTOMER TERMINAL APPARATUS AND INFORMATION DISTRIBUTION SERVER

(75) Inventors: Toshifumi Hoshii, Fussa (JP); Takeshi Kasahara, Fussa (JP); Kimiyasu Mizuno, Fussa (JP); Hiroki Takahashi, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 526 days.

(21) Appl. No.: 09/588,061

(22) Filed: Jun. 6, 2000

(30) Foreign Application Priority Data

Jun. 28, 1999 (JP) ..... 11-181306
Jun. 29, 1999 (JP) ..... 11-183153

(51) Int. Cl.[7] ..... B41F 1/54; B41F 1/66; B41F 33/00; B41L 39/00; B41L 47/56; B41L 5/12

(52) U.S. Cl. ..... 101/484; 400/61; 400/70; 400/76

(58) Field of Search ..... 101/484; 400/76, 400/70, 61

(56) References Cited

U.S. PATENT DOCUMENTS

| | | | | |
|---|---|---|---|---|
| 5,034,806 A | | 7/1991 | Ikeda et al. | |
| 5,181,162 A | | 1/1993 | Smith et al. | |
| 5,707,158 A | | 1/1998 | Hansel et al. | |
| 5,724,521 A | | 3/1998 | Dedrick | |
| 5,740,549 A | * | 4/1998 | Reilly et al. | 705/14 |
| 5,765,142 A | | 6/1998 | Allred et al. | |
| 5,845,262 A | * | 12/1998 | Nozue et al. | 705/26 |
| 5,979,757 A | | 11/1999 | Tracy et al. | |
| 6,014,137 A | | 1/2000 | Burns | |
| 6,018,774 A | | 1/2000 | Mayle et al. | |
| 6,073,241 A | * | 6/2000 | Rosenberg et al. | 713/201 |
| 6,295,482 B1 | | 9/2001 | Tognazzini | |
| 6,320,672 B1 | | 11/2001 | Itoh | |

(List continued on next page.)

FOREIGN PATENT DOCUMENTS

| | | |
|---|---|---|
| EP | 0 326 515 A1 | 8/1989 |
| EP | 0 649 109 A1 | 4/1995 |
| EP | 0 854 458 A2 | 7/1998 |

(List continued on next page.)

OTHER PUBLICATIONS

Copy of related U.S. patent application Ser. No. 09/588,081 filed Jun. 6, 2000; Inventors: Kimiyasu Mizuno et al; title: Customer Terminal Apparatus, Its System, Image Saving System, and Recording Medium Which Records That Program.

Copy of U.S. Patent Office Action dated Oct. 17, 2002 issued in related U.S. patent application Ser. No. 09/588,081 filed Jun. 6, 2000.

Copy of related U.S. patent application Ser. No. 09/588,062 filed Jun. 6, 2000; Inventors: Kimiyasu Mizuno et al; title: "Customer Terminal Apparatus, Its System, and Recording Medium With Records That Program".

Copy of European Office Action dated Mar. 14, 2002 cited in related U.S. patent application Ser. No. 09/588,062 filed Jun. 6, 2000.

*Primary Examiner*—Charles H. Nolan, Jr.
(74) *Attorney, Agent, or Firm*—Frishauf, Holtz, Goodman & Chick, P.C.

(57) ABSTRACT

Each image print apparatus is connected to a nearest base station by radio, and a plurality of base stations are connected to a public communication network. A server apparatus is connected to the public communication network. The server apparatus sends an image of advertisement information to a plurality of image print apparatuses via the public communication network and base stations, and each image print apparatus additionally prints the image of advertisement information received from the server apparatus on a photo image to be printed, which is designated by the customer.

5 Claims, 22 Drawing Sheets

U.S. PATENT DOCUMENTS

| | | | | | |
|---|---|---|---|---|---|
| 6,334,109 | B1 | * | 12/2001 | Kanevsky et al. | 705/14 |
| 6,637,653 | | | 4/2002 | Ruskin et al. | |
| 2001/0014868 | A1 | * | 8/2001 | Herz et al. | 705/14 |
| 2001/0016829 | A1 | * | 8/2001 | Toshikage et al. | 705/26 |
| 2001/0030773 | A1 | * | 10/2001 | Matsuura et al. | 358/471 |

FOREIGN PATENT DOCUMENTS

| | | | | | |
|---|---|---|---|---|---|
| FR | 2 665 812 | A1 | | 2/1992 | |
| FR | 0 682 502 | A1 | | 4/1993 | |
| FR | 2 741 987 | A1 | | 6/1997 | |
| GB | 2 305 259 | A | | 4/1997 | |
| JP | 10-210208 | A | | 8/1998 | |
| JP | 2000188741 | A | * | 7/2000 | H04N/7/14 |
| JP | 2001010149 | A | * | 1/2001 | B41J/21/00 |
| JP | 2002133141 | A | * | 5/2002 | G06F/17/60 |
| KR | 2001035449 | A | * | 5/2001 | G06F/17/60 |
| KR | 2001068106 | A | * | 7/2001 | G06F/17/60 |
| WO | WO 93/16443 | A1 | | 8/1993 | |
| WO | WO 98/40826 | A2 | | 9/1998 | |

* cited by examiner

| AREA CODE | ADVERTISEMENT NO. | ADVERTISEMENT CONTENT | ADVERTISER | TASTE | GENDER | AGE | REGISTRATION DATE | VALID PERIOD |
|---|---|---|---|---|---|---|---|---|
| AREA A | | | | | | | | |
| | | | | | | | | |
| | | | | | | | | |
| | | | | | | | | |
| AREA B | | | | | | | | |
| | | | | | | | | |
| | | | | | | | | |

FIG.6

| ADVERTISEMENT NO. | ADVERTISEMENT CONTENT (IMAGE DATA) |
|---|---|
| 1 | |
| 2 | |
| 3 | |
| | |
| | |

FIG.7A

| TASTE | GENDER | AGE | ADVERTISEMENT NO. |
|---|---|---|---|
| FASHION | MALE | ~20 | |
| | | 21~30 | |
| | | 31~50 | |
| | | 51~ | |
| | FEMALE | ~20 | |
| | | 21~30 | |
| | | 31~40 | |
| | | 41~ | |
| SPORTS | MALE | ~20 | |
| | | 21~30 | |
| | | | |

FIG.7B

| AREA CODE | IMAGE PRINT APPARATUS | CONNECTION NUMBER |
|---|---|---|
| AREA A | | |
| | | |
| | | |
| | | |
| | | |
| | | |
| AREA B | | |
| | | |
| | | |
| | | |
| | | |
| | | |
| | | |
| | | |

FIG.8

CUSTOMER TERMINAL APPARATUS AND INFORMATION DISTRIBUTION SERVER

CROSS-REFERENCE TO RELATED APPLICATIONS

This application is based upon and claims the benefit of priority from the prior Japanese Patent Applications No. 11-181306, filed Jun. 28, 1999; and No. 11-183153, filed Jun. 29, 1999, the entire contents of which are incorporated herein by reference.

BACKGROUND OF THE INVENTION

The present invention relates to a customer terminal apparatus and information distribution server.

Customer terminal apparatuses such as automatic vending machines and the like, which can issue various kinds of prints for pay to customers, are known.

However, in such automatic vending machine, the print cost per photo to be printed is considerably high, and the print fee bottlenecks soaring sales figures.

Various kinds of print information provided by the automatic vending machine are read out and issued as a print as needed in accordance with customers' requests. The print information must be set and registered in that vending machine in advance, and when the print information is to be changed, a service person must go to the site of that vending machine to change the print information, resulting in troublesome maintenance jobs.

On the other hand, an on-line system in which the automatic vending machine is connected to a center via a communication line, and print information can be provided on-line in response to a customer's request has been proposed. However, in such system, the vending machine must communicate with the center every time a customer operates. For this purpose, the communication line must be constantly connected, and when the center has closed, it cannot respond to a request from that terminal.

BRIEF SUMMARY OF THE INVENTION

It is an object of the present invention to reduce the fee upon selling pay goods such as photo image prints or the like at a customer terminal apparatus.

It is another object of the present invention to allow easy maintenance by automatically distributing pay advertisement information provided to reduce the fee upon selling goods at the customer terminal apparatus via communications.

According to the present invention, a customer terminal apparatus which prints a photo image designated by a customer for pay while charging the customer a predetermined fee, is characterized in that advertisement information provided in advance by an advertiser is stored, whether or not the advertisement information is additionally printed on the photo image is designated, the fee is changed in accordance with the presence/absence of designation of the additional print, and upon printing the photo image designated by the customer, if the additional print is designated, that advertisement information is additionally printed.

Also, according to the present invention, a customer terminal apparatus operated by a customer, is characterized in that advertisement information sent from an information distribution server is received, the received advertisement information is stored, and upon selling a designated commodity on the basis of commodity information designated by the customer, the advertisement information, which is distributed from the information distribution server and stored, is output.

Furthermore, according to the present invention, an information distribution server for distributing information to a plurality of customer terminal apparatuses operated by customers, is characterized in that a plurality of pieces of advertisement information are stored, advertisement information to be output by each of the customer terminal apparatuses is selected from the plurality of pieces of advertisement information in units of customer terminal apparatuses, and the selected advertisement information is distributed to the corresponding customer terminal apparatus.

According to the present invention, in a customer terminal apparatus which prints a photo image designated by the customer for pay, when the customer designates additional print of advertisement information, since the fee for the pay photo is discounted or becomes free, the customer can get a low-priced or free photo image print.

Ordinarily, the print process of a photo image is expensive. However, according to the present invention, since advertisement information is additionally printed on that photo image, the sales cost per photo print can be minimized (free in some cases) by imposing that print cost on the advertiser. On the customer side, despite the demerit that an advertisement is added, the low price is attractive. Therefore, a vending apparatus which can stimulate potential demands for printing photo images can be provided.

Especially for the advertiser, since its advertisement is composited and printed on a photo print of an end user, and such prints are highly likely to be distributed to many people, a high advertising effect of that advertisement is expected. Even when the advertisement fee is high, such cost is well paid, and consumers and advertisers can both benefit.

Also, according to the present invention, since the pay advertisement information stored in the customer terminal apparatus is simultaneously automatically distributed from the server apparatus on the center side and is updated if required, not only easy maintenance of the pay advertisement information but also low communication cost can be achieved.

Furthermore, when there are a plurality of customer terminal apparatuses, advertisement information which is most suitable for a group of customers who operate each customer terminal apparatus or an area where the apparatus of interest is set is selected from a large number of pieces of advertisement information, and the selected advertisement information can be immediately distributed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 6 shows a master file stored in a storage device in the server apparatus;

FIG. 7A shows a table of advertisement contents;

FIG. 7B shows a table for customer group genres;

FIG. 8 shows data of a terminal management table;

DETAILED DESCRIPTION OF THE INVENTION (First Embodiment)

The preferred embodiment of the present invention will be described hereinafter with reference to FIGS. 1 to 18.

Figure 1:
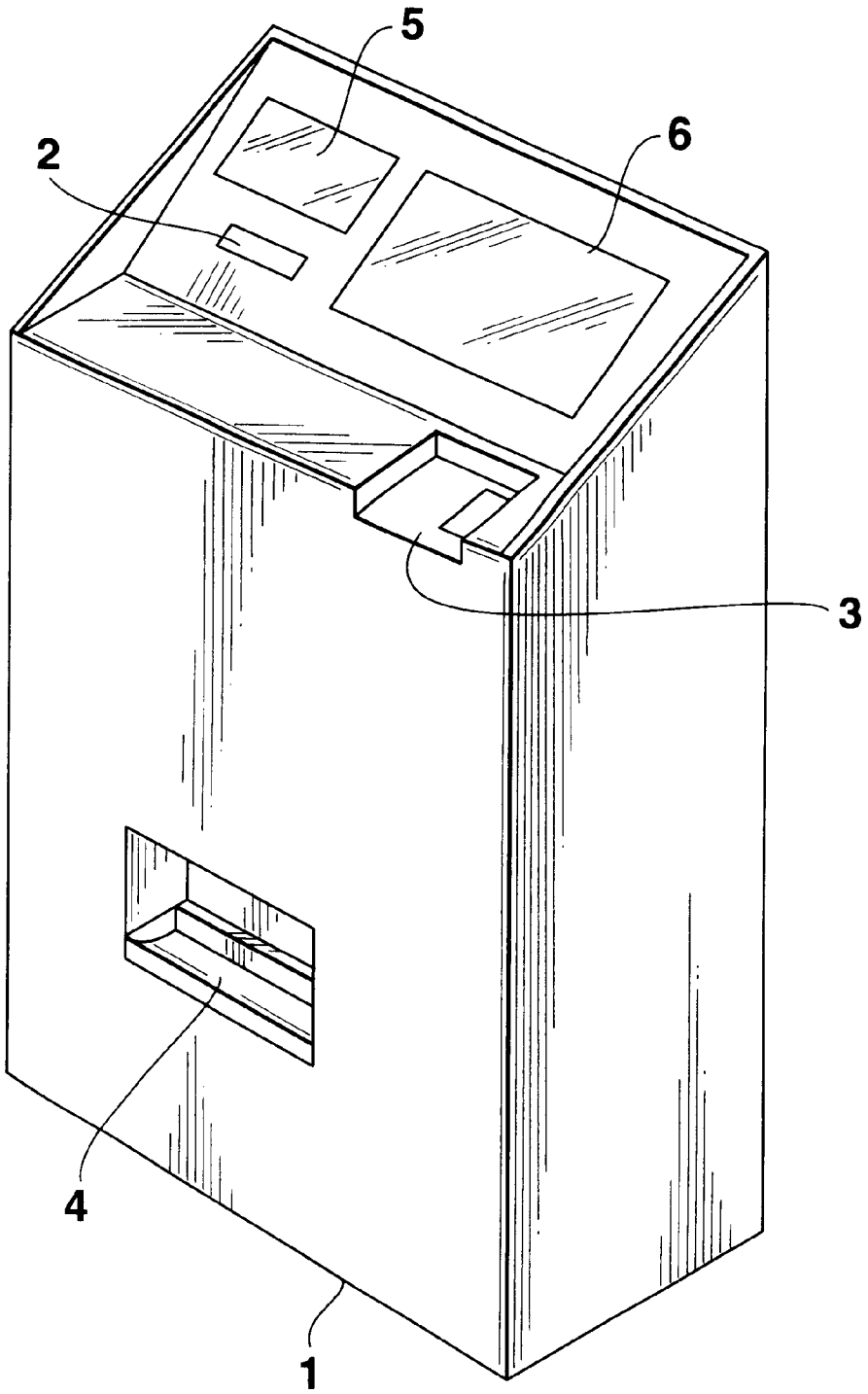
FIG. 1 is a perspective view showing the outer appearance of an image print apparatus.

FIG. 1 shows the outer appearance of an image print apparatus 1 as an example of a customer terminal apparatus operated by customers.

This apparatus has a recording medium insert port 2 for receiving a recording medium of photo image data (to be simply referred to as a "photo image" hereinafter) sensed by a digital camera on its upper portion.

This embodiment uses as a recording medium a memory card called a CF (compact flash) card capable of storing photo images of several to several 10 Mbytes. As other recording media, a PC card, smartmedia card, MO (magnetooptical disk), FD (floppy disk), and the like may be used.

The apparatus 1 also has at another position of its upper portion a fee insert/return port 3 in which the customer inserts paper money and coins for a print fee and from which he or she receives money inserted upon cancel or change. Furthermore, the apparatus 1 has on its lower portion a printed photo outlet port 4 from which a print of a photo image is exhausted. Moreover, the apparatus 1 has on its upper portion a console 5 including various buttons that the customer operates, and a display unit 6 for displaying guidance messages, a fee, and the like.

Figure 2:
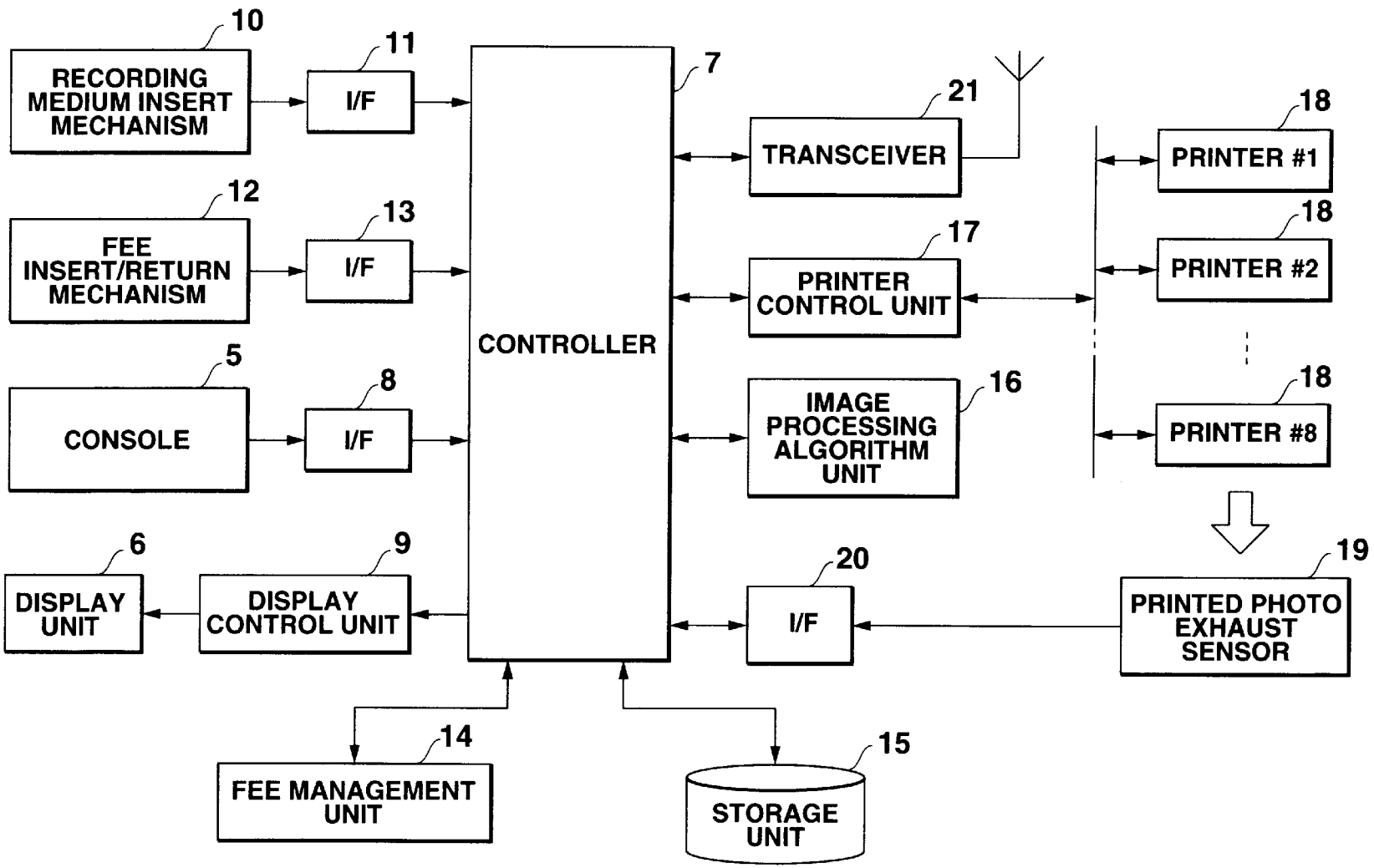
FIG. 2 is a block diagram showing the internal arrangement of the image print apparatus.

FIG. 2 is a block diagram showing the internal arrangement of the apparatus 1. A controller 7 comprises a ROM that stores a program, a control module for controlling the entire apparatus 1 in accordance with the program, and various registers required for control.

An interface (I/F) 8 detects the ON/OFF states of the individual buttons on the console 5 in response to a scan signal from the controller 7, and inputs the detected states to the controller 7. A display control unit 9 renders image data supplied from the controller 7 to one frame, and outputs it to the display unit 6, thus displaying the rendered data.

A recording medium insert mechanism 10 is constructed by a mechanism for loading and unloading a memory card, its driving unit, and an image reader for reading a photo image recorded on the loaded memory card.

An interface 11 controls the recording medium insert mechanism 10 in accordance with a control command from the controller 7, and inputs a photo image read by the recording medium insert mechanism 10 to the controller 7.

A fee insert/return mechanism 12 detects, sorts, and inspects inserted paper money and coins, and exhausts paper money and coins to be returned.

An interface 13 inputs a detection signal, sort signal, and inspection signal from the fee insert/return mechanism 12 to the controller 7.

A fee management unit 14 stores a plurality of kinds of fee system data as a table. The controller 7 looks up the table to select a corresponding fee system on the basis of data input from the console 5.

A storage unit 15 stores image data of a plurality of kinds of advertisement information (to be simply referred to as "images of advertisement information" hereinafter), and temporarily stores a photo image read from the memory card loaded into the recording medium insert mechanism 10.

An image processing algorithm unit 16 executes an image processing algorithm for a photo image and an advertisement image. Note that the image processing algorithm can be implemented by software by the storage unit 15 and the controller 7 that executes a program in place of a hardware image processing algorithm unit 16, when an arithmetic processor that constructs the control module of the controller 7 has high processing speed.

A printer control unit 17 controls eight printers 18 connected to the apparatus, and outputs a print command and print data from the controller 7 to the printers 18. A printed photo exhaust sensor 19 checks if prints printed by the printers 18 are exhausted to the printed photo outlet port 4.

An interface 20 inputs the detection result of the printed photo exhaust sensor 19 to the controller 7.

Figure 3:
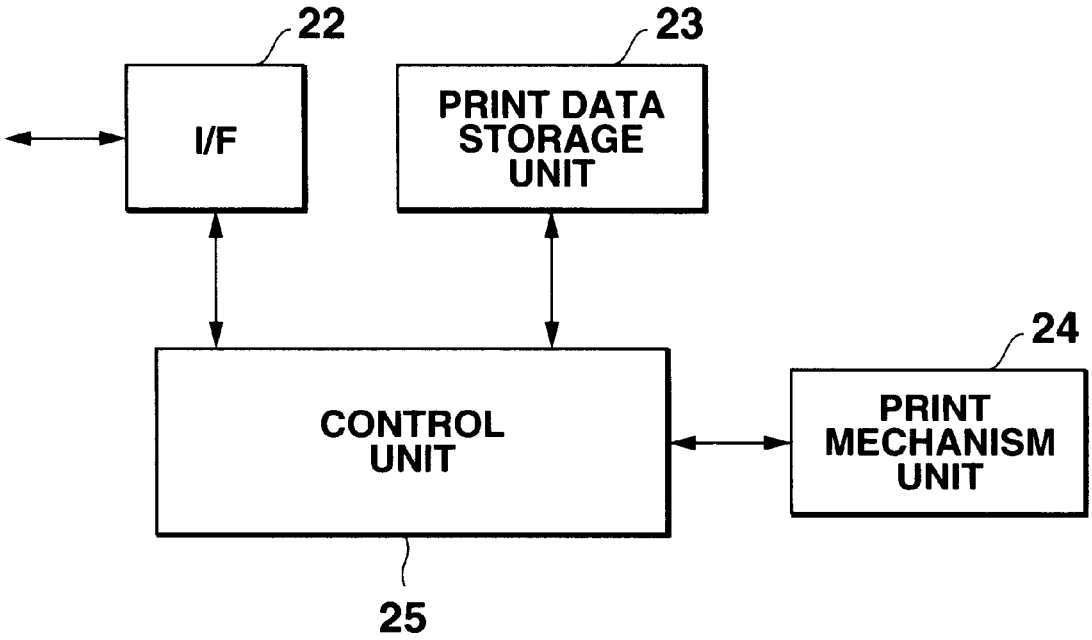
FIG. 3 is a block diagram showing the arrangement of a printer.

As shown in FIG. 3, each printer 18 comprises an interface 22 for exchanging commands such as a print command and the like, and print data with the printer control unit 17, a print data storage unit 23 for temporarily storing print data, and a print mechanism unit 24 for actually printing an image. A control unit 25 renders print data supplied from the printer control unit 17 via the interface 22 into a print format, stores it in the print data storage unit 23, reads out the stored data, and supplies the readout data to the print mechanism unit 24.

A transceiver 21 shown in FIG. 2 comprises a versatile PHS or portable phone, and establishes a connection to a public telephone network using a telephone number as unique identification information. The transceiver 21 communicates with a base station and a server apparatus via the public communication network and receives an image of advertisement information from the server apparatus.

Figure 4:
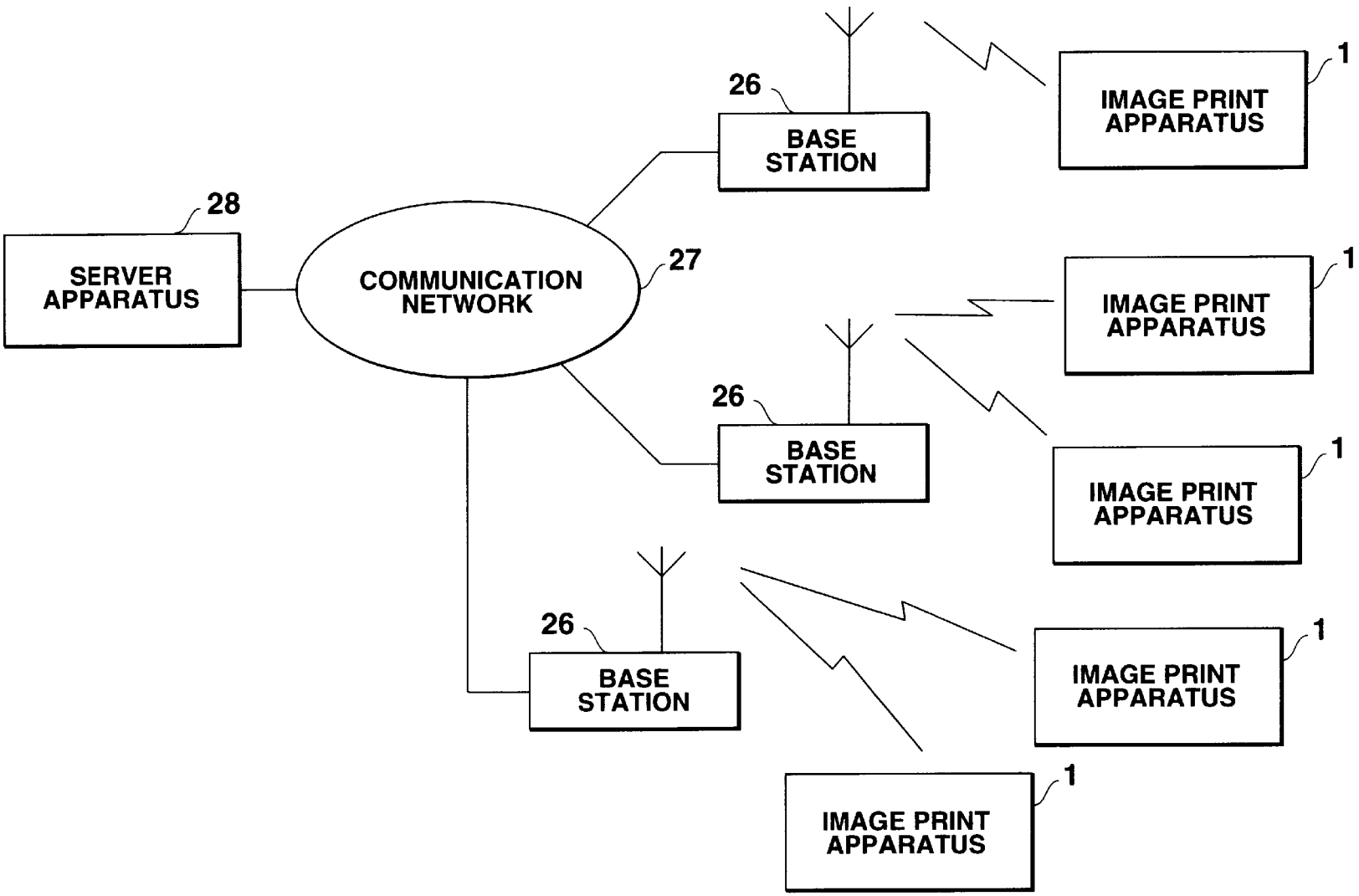
FIG. 4 is a diagram showing the arrangement of a system in which image print apparatuses and a server apparatus are connected via a public communication network.

FIG. 4 shows the system arrangement built by connecting a plurality of image print apparatuses 1 to a server apparatus via the public communication network. Each image print apparatus 1 is connected to a nearest base station 26 by radio. A plurality of base stations 26 are connected to a public communication network 27 via lines.

A server apparatus 28 is similarly connected to public communication network 27. Therefore, the server apparatus 28 can connect one or all of the image print apparatuses 1 via the public communication network 27 and base stations 26. That is, each image print apparatus 1 constructs a terminal apparatus, and the server apparatus 28 constructs a terminal management apparatus that manages the plurality of terminal apparatuses via communications.

Figure 5:
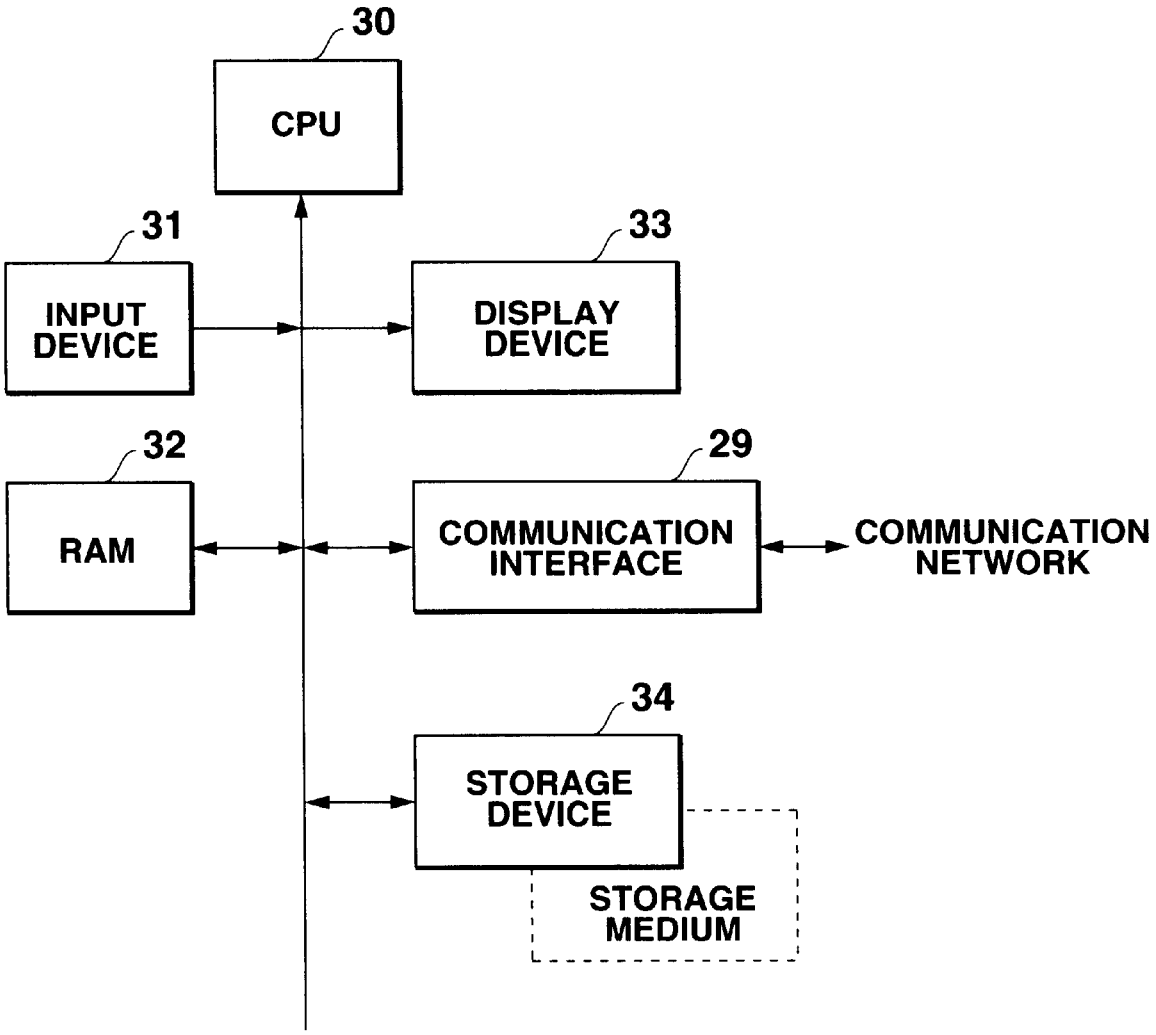
FIG. 5 is a block diagram showing the internal arrangement of the server apparatus.

FIG. 5 is a block diagram showing the internal arrangement of the server apparatus 28.

A communication interface 29 connects the public communication network 27 and server apparatus 28 shown in FIG. 4. A CPU 30 originates calls to the individual terminal apparatuses (the individual image print apparatuses 1) via a communication interface 29 connected thereto via the internal bus. Also, the CPU 30 exchanges commands and data with an input device 31, RAM 32, display device 33, and storage device 34 connected thereto via the internal bus, and controls the entire server apparatus 28.

The input device 31 inputs registration information in accordance with a registration request from an advertiser, and also an image of advertisement information provided by the advertiser. The input registration information and image of advertisement information are stored as data of a master file in the storage device 34. In this case, the advertiser designates the advertising area upon registration.

FIG. 6 shows the master file stored in the storage device 34. A plurality of pieces of input registration information (to be referred to as "records" hereinafter) are classified in units of areas using area codes, and the advertisement contents (images of advertisement information), advertisers, registration dates, and advertisement valid periods are specified by their advertisement numbers. Also, customer information which is input by the advertiser and includes tastes, genders, and ages of customers is saved in the master file.

Note that expired records are deleted from the master file, but are not immediately deleted from the storage device and are stored in an expired file in another area, so that they are saved to be able to restore in response to a re-registration request from the advertiser.

The CPU 30 generates advertisement file data, customer group genre table data, and terminal management table data for the terminal apparatuses on the basis of this master file in an advertisement update process (to be described later).

The advertisement file stores advertisement contents in correspondence with advertisement numbers, and a corresponding advertisement content, i.e., an image of advertisement information can be read out from this file by designating the advertisement number, as shown in FIG. 7A.

A customer group genre table stores customer information including tastes, genders, and ages in correspondence with the advertisement numbers, as shown in FIG. 7B. When the customer inputs his or her customer information at the terminal apparatus, that customer information is sent to the server apparatus, and the CPU 30 can specify the corresponding advertisement number by looking up this table.

In the terminal management table for the terminal apparatuses, i.e., terminal information, the terminal apparatuses which are classified in units of areas using area codes, as shown in FIG. 8, are designated by their telephone numbers, i.e., connection numbers.

The operation of the image print system of this embodiment will be explained below with reference to the flow charts of the server apparatus serving as the terminal management apparatus, and the image print apparatus serving as the terminal apparatus.

Figure 9A:
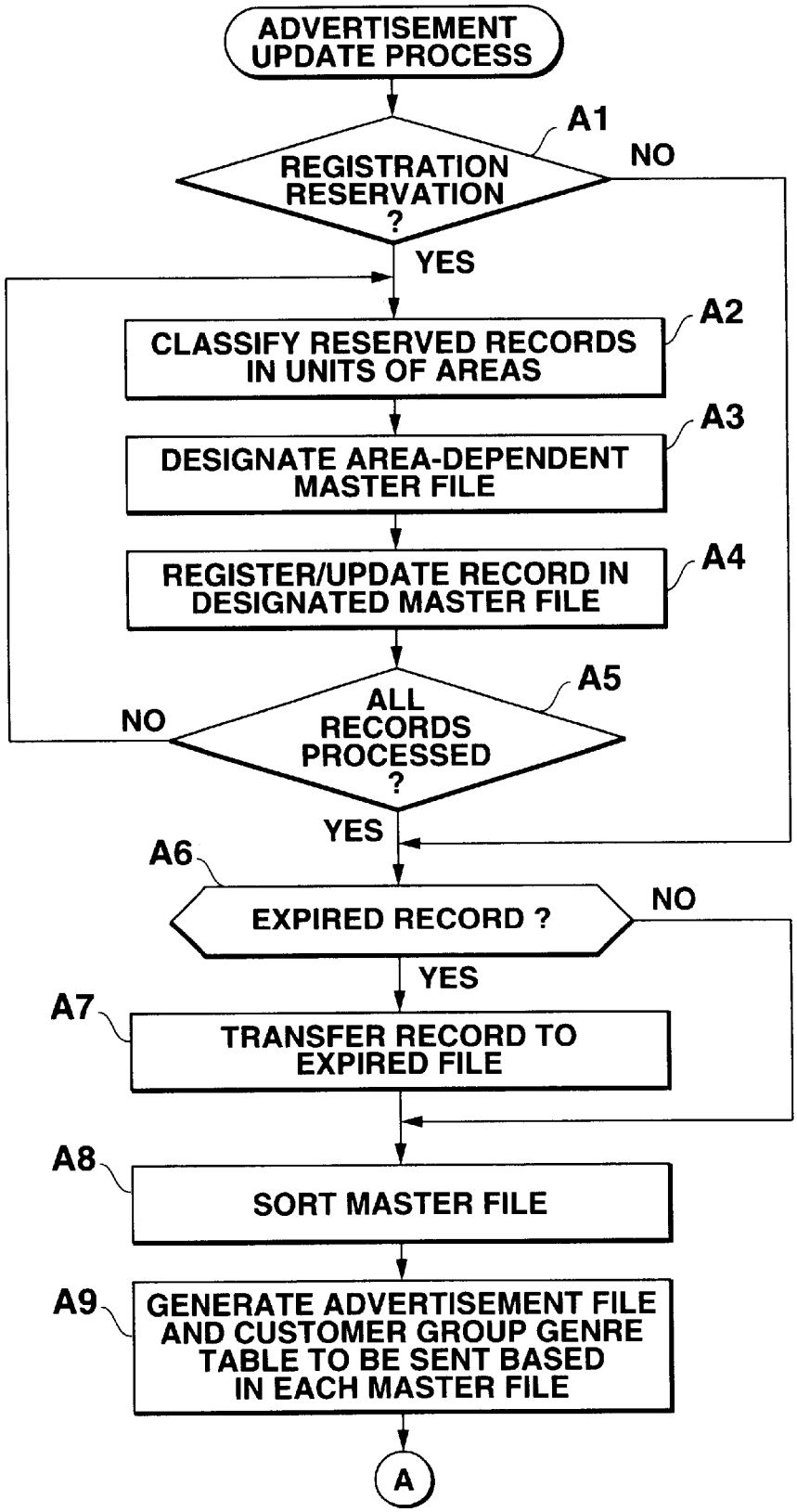
FIG. 9A is a flow chart of an advertisement update process of the server apparatus.
Figure 9B:
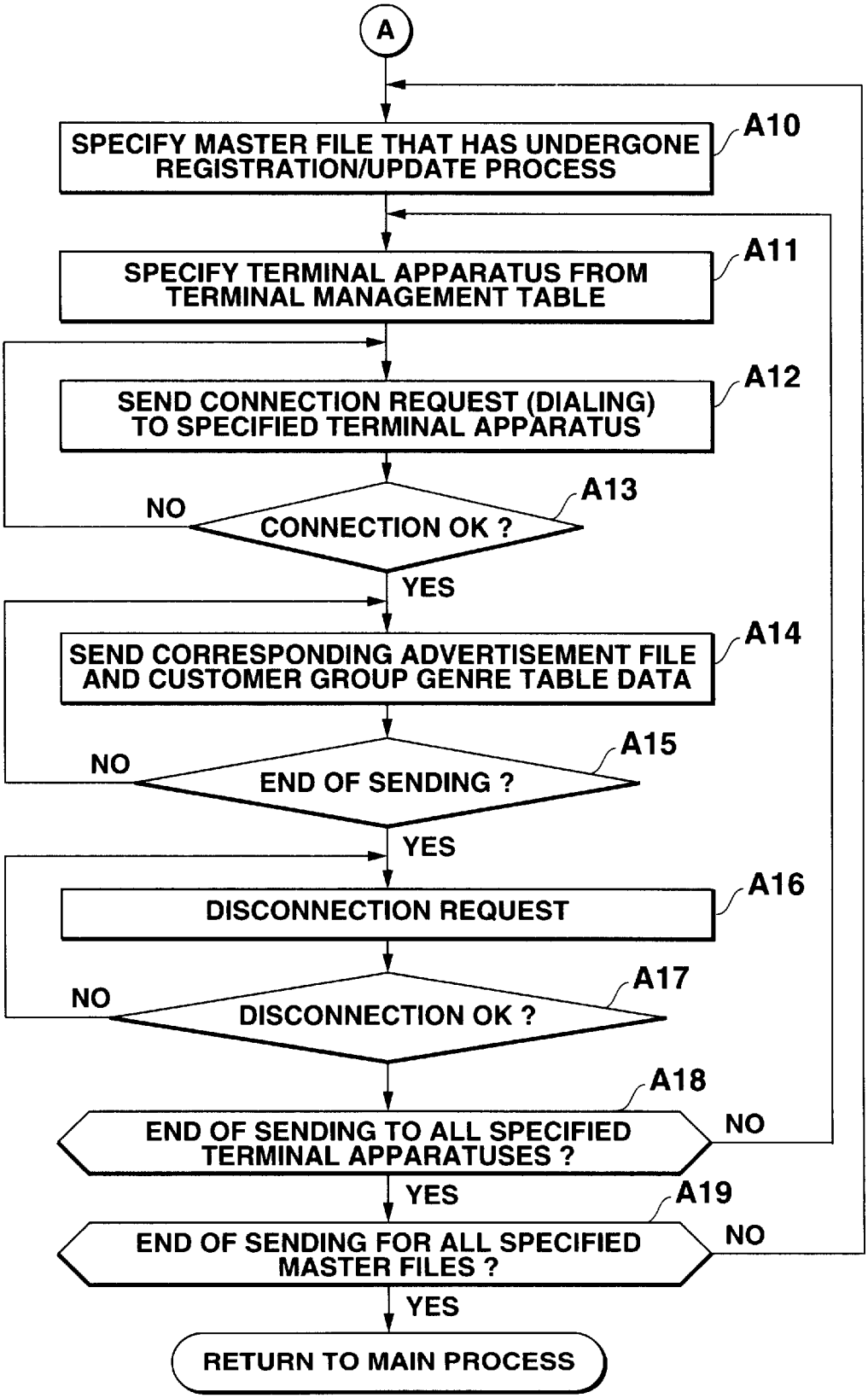
FIG. 9B is a flow chart continued from FIG. 9A.

The operation of the server apparatus will be explained below. FIGS. 9A and 9B are flow charts showing the advertisement update process of the server apparatus. When the advertisement content is registered or updated, the control advances from a main process (not shown) to this flow.

Referring to FIG. 9A, the CPU 30 checks if a registration reservation of the advertiser is found (step A1). If a registration reservation is found, the CPU 30 classifies that reserved record in units of areas (step A2). The CPU 30 then designates a master file in units of areas (step A3). The CPU 30 registers or updates the record in the designated master file (step A4). After that, the CPU 30 checks if all records have been registered or updated (step A5). If records to be registered or updated still remain, the flow returns to step A2 to repeat the processes up to step A4.

If all the records have been registered or updated, or if no registration reservation is found in step A1, the CPU 30 checks if an expired record, the valid period of which has expired, is found (step A6). If an expired record is found, the CPU 30 transfers that record to an expired file (step A7). Then, the CPU 30 sorts records in the master file (step A8).

The CPU 30 searches the master file corresponding to each terminal apparatus for the advertisement file and customer group genre table shown in FIGS. 7A and 7B (step A9). In the flow shown in FIG. 9B, the CPU 30 specifies the master file that has undergone the registration or update process (step A10). The CPU 30 then specifies the terminal apparatus from the terminal management table shown in FIG. 8 (step A11).

The CPU 30 issues a connection request to the specified terminal apparatus, i.e., calls (dials) that terminal apparatus (step A12). The CPU 30 checks if a connection OK reply is sent back from that terminal apparatus (step A13).

If no reply is received, the CPU 30 repeats calling (dialing) in step A12. If a connection OK reply is received from the terminal apparatus, the CPU 30 sends the advertisement file and customer group genre table data corresponding to that terminal apparatus (step A14).

The CPU 30 checks if all data have been sent (step A15). If data to be sent still remain, the CPU 30 continues the sending process in step A14. Upon completion of sending, the CPU 30 issues a disconnection request to the terminal apparatus (step A16). The CPU 30 checks if a disconnection OK reply is received from the terminal apparatus (step A17).

If a disconnection OK reply is received from the terminal apparatus, the CPU 30 checks if data have been sent to all terminal apparatuses specified from a given master file (step A18). If terminal apparatuses to which data are to be sent still remain, the flow returns to step A11 to repeat the processes up to step A18, thus sending data to the terminal apparatus.

If data have been sent to all the terminal apparatuses specified from a given master file, the CPU 30 checks if data have been sent to all specified master files that have undergone the registration or update process (step A19). If master files to which data are to be sent still remain, the flow returns to step A10 to repeat the processes up to step A19. If data have been sent to all the specified master files, the CPU 30 ends this flow and returns to the main process.

The operation of the terminal apparatus will be explained below with reference to the block diagram shown in FIG. 2 and FIGS. 10 to 18.

Figure 10:
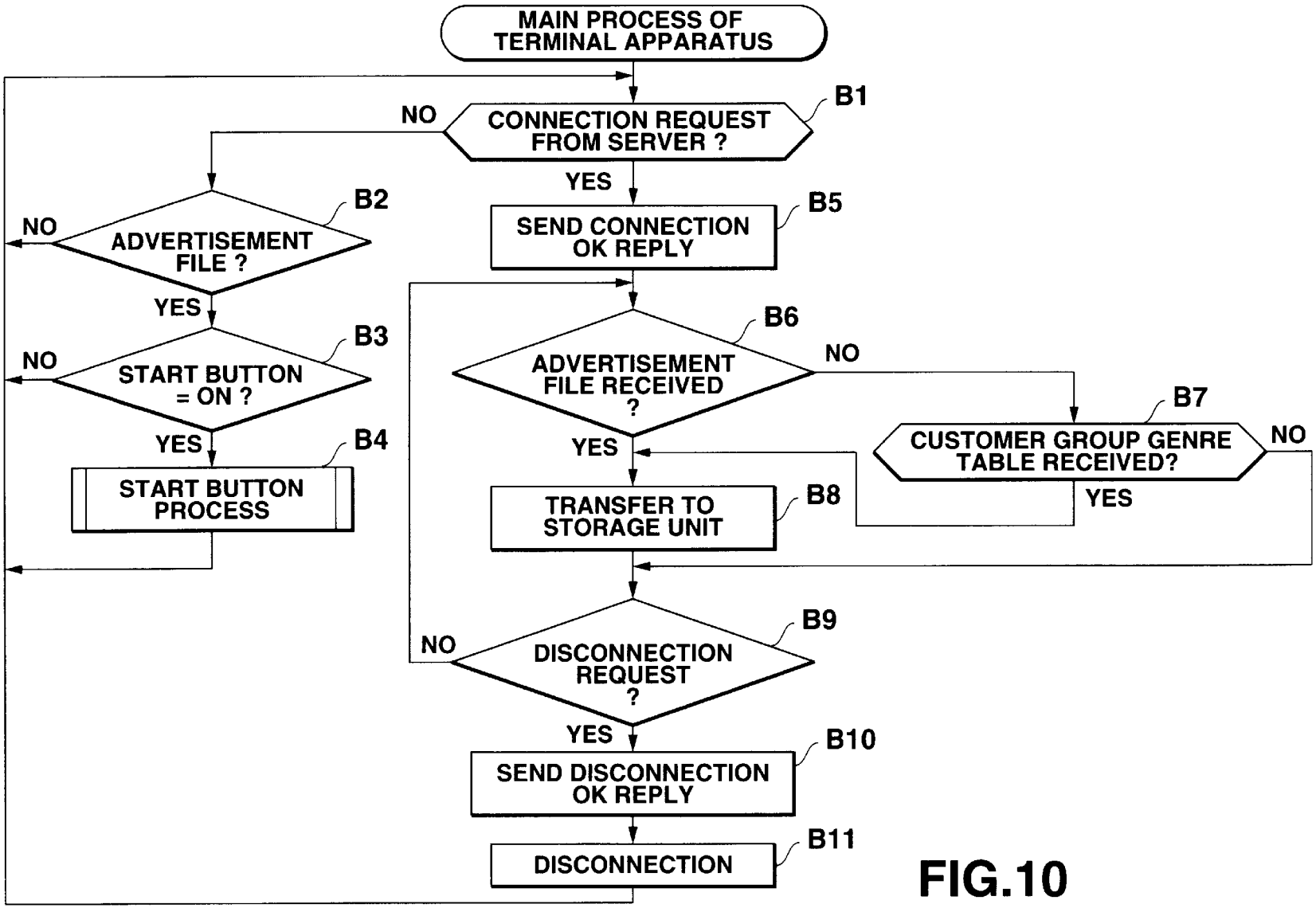
FIG. 10 is a flow chart showing a main process of the image print apparatus.

FIG. 10 shows the flow of a main process of each terminal apparatus. The controller 7 shown in FIG. 2 monitors the transceiver 21 to check if a connection request is received from the server apparatus (step B1). If N (NO) in step B1, the controller 7 checks if an advertisement file is stored in the storage unit 15 (step B2). If N In step B2, since the terminal apparatus has no image of advertisement information to be printed, the controller 7 waits for a connection request from the server apparatus in step B1.

If an advertisement file is stored in the storage unit 15, the controller 7 checks if a start button of the console 5 is ON (step B3). If Y (YES) in step B3, the controller 7 executes a start button process in step B4; otherwise, the controller 7 waits for a connection request from the server apparatus in step B1.

If a connection request is received from the server apparatus, the controller 7 sends a connection OK reply (step B5). The controller 7 checks if advertisement file data is received from the server apparatus (step B6), or if customer group genre table data is received therefrom (step B7). If either data is received, the controller 7 transfers the received data to the storage unit 15 (step B8).

After the received data is transferred or if neither data are received, the controller 7 checks if a disconnection request is received from the server apparatus (step B9). If N in step B9, the controller 7 waits for data reception in step B6 or B7. If a disconnection request is received in step B9, the controller 7 sends a disconnection OK reply (step B10).

The controller 7 then executes a disconnection process, e.g., a save process of communication history and errors, and the like (step B11), and the flow returns to step B1 to wait for a connection request from the server apparatus again.

Figure 11:
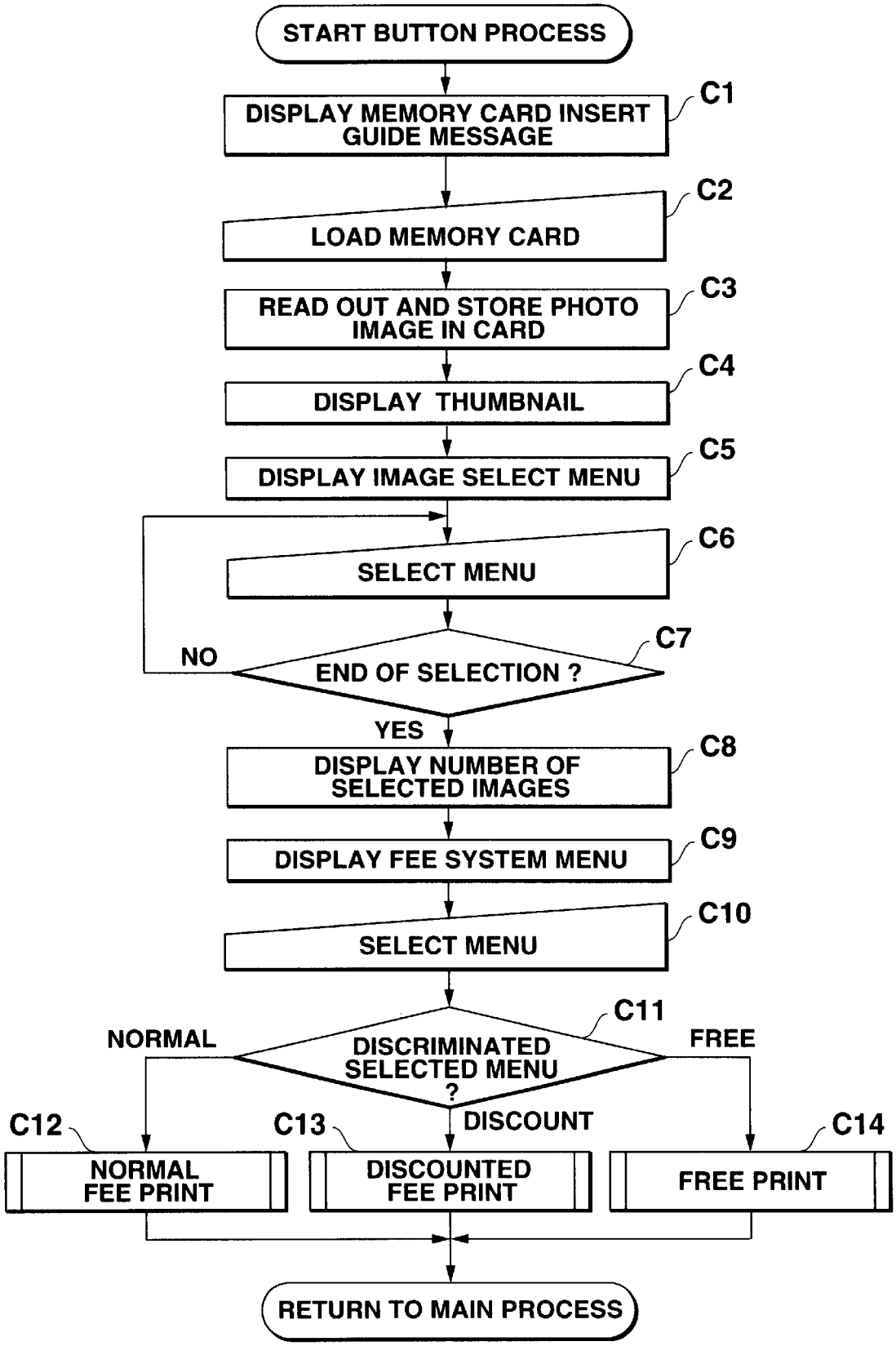
FIG. 11 is a flow chart showing a start button process.

FIG. 11 is a flow chart showing the start button process in step B4 in FIG. 10. The controller 7 displays a guide message for prompting the customer to insert a memory card on the display unit 6 (step C1). The control waits for insertion of a memory card via the interface 11. If the customer inserts a memory card (step C2), the controller 7 reads out an image file in that memory card, i.e., photo images sensed by a digital camera, and stores them in the storage unit 15 (step C3).

In this case, since photo images have different formats depending on camera manufacturers, the customer may input the manufacturer name. In this embodiment, the controller 7 automatically detects the format based on, e.g., an index or the like of the memory card, executes an image process that is concordant with the detected format, and stores the processed image in the storage unit 15.

The controller 7 controls the image processing algorithm unit 16 to form reduced-scale images (thumbnails) of all frames of stored photo images. The controller 7 then displays thumbnails on the display unit 6 (step C4). Also, the controller 7 displays an image select menu on that window (step C5).

Figure 12:
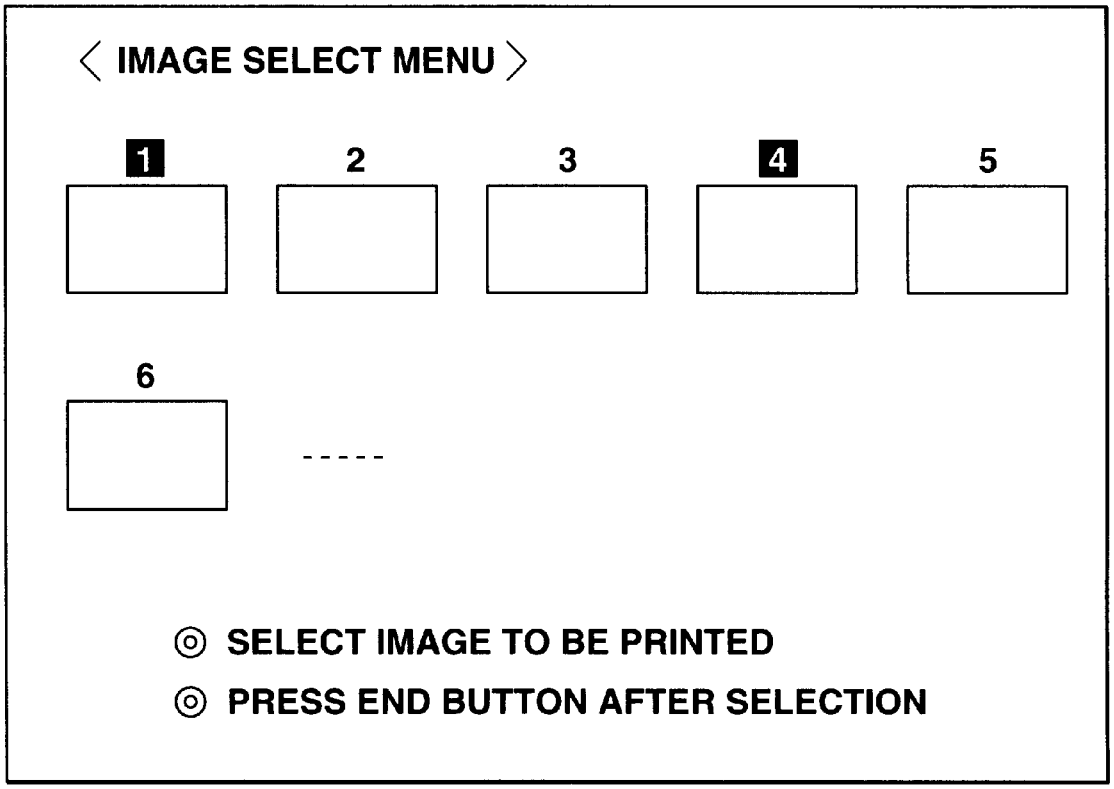
FIG. 12 shows an image select menu window displayed on a display unit.

More specifically, as shown in FIG. 12, all the frames of photo images are displayed together with their frame numbers, and a message for prompting the customer to input the frame number of a photo image to be printed is displayed. If the customer selects a menu item and inputs the frame number (step C6), the controller 7 executes, e.g., a process for changing the display state of the selected frame number. The controller 7 then detects the state of an end button of the console 5 to determine the end of selection (step C7). If N in step C7, the controller 7 waits for the frame number input by the customer in step C6.

Figure 13:
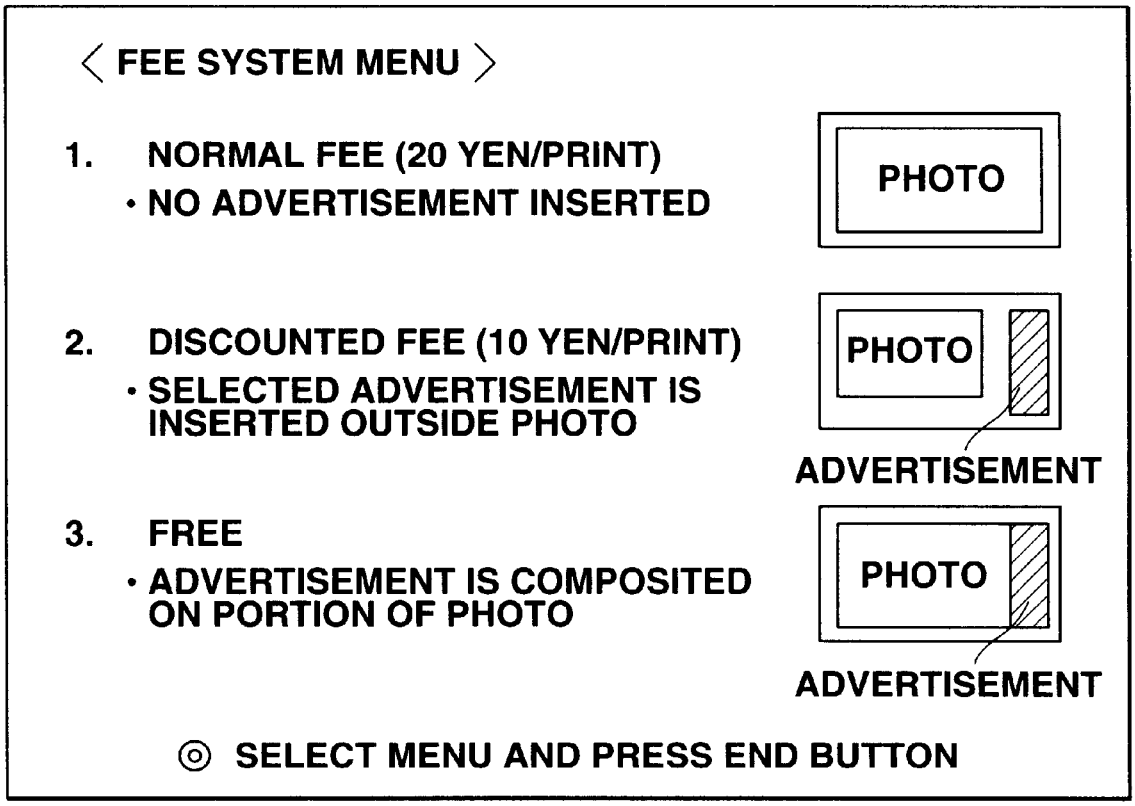
FIG. 13 shows a fee system menu window displayed on the display unit.

Upon completion of selection, the controller 7 displays the number of selected frames (step C8). The controller 7 then displays a fee system menu (step C9). FIG. 13 shows the window of the fee system menu. Menu item 1 indicates a case of normal pay print that requires the customer to pay a predetermined print fee, and displays a message indicating that a photo image alone is printed and no advertisement is inserted.

Menu item 2 indicates a case of discounted fee print that discounts a predetermined print fee, and displays a message indicating that an advertisement selected by the customer is inserted outside the photo. Menu item 3 indicates a case of free print, and displays a message indicating that an advertisement is partially superimposed on the photo. Also, illustrations of the print formats of these menu items are displayed.

In the flow shown in FIG. 11, if the customer selects one of these menu items (step C10), the controller 7 discriminates the selected menu item (step C11). If menu item 1 is selected, the controller 7 executes a normal fee print subroutine (step C12). If menu item 2 is selected, the controller 7 executes a discounted fee print subroutine (step C13). If menu item 3 is selected, the controller 7 executes a free print subroutine (step C14). Upon completion of the process of the subroutine corresponding to the selected menu item, the flow returns to the main process.

Figure 14:
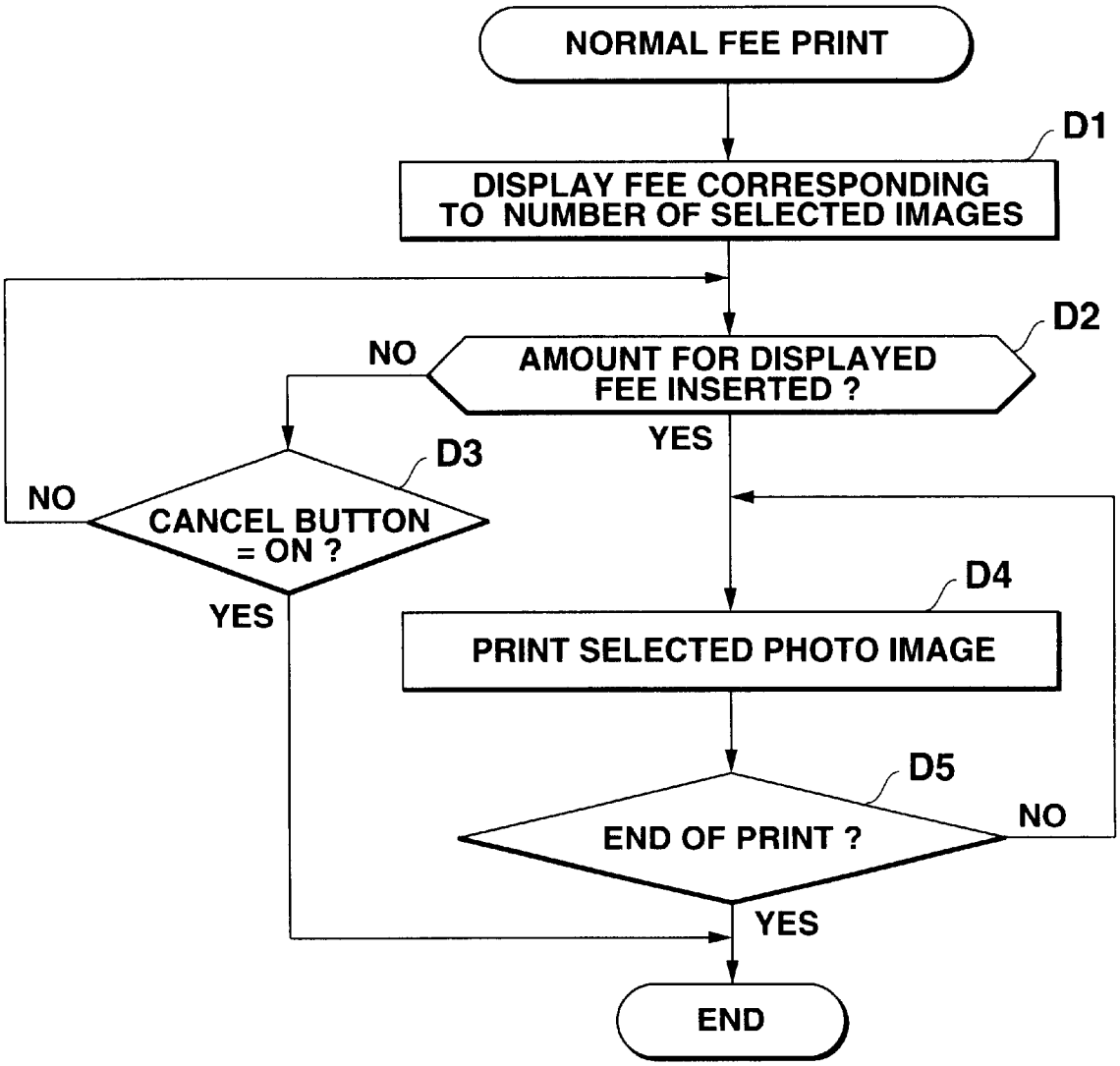
FIG. 14 is a flow chart showing a normal fee print process.

FIG. 14 is a flow chart showing the normal fee print subroutine in step C12. The controller 7 displays a fee corresponding to the number of selected images (step D1), and checks if the amount for the displayed fee is inserted from the fee insert/return port 3 (step D2). While N in step D2, the controller 7 checks if a cancel button of the console 5 is ON (step D3). If Y in step D3, the controller 7 ends this flow. If the amount for the displayed fee is inserted, the controller 7 prints the selected photo images (step D4).

The controller 7 checks if all the selected photo images have been printed (step D5). If photo images to be printed still remain, the controller 7 continues the print process in step D4. If all the selected photo images have been printed, the controller 7 ends this flow.

Figure 15:
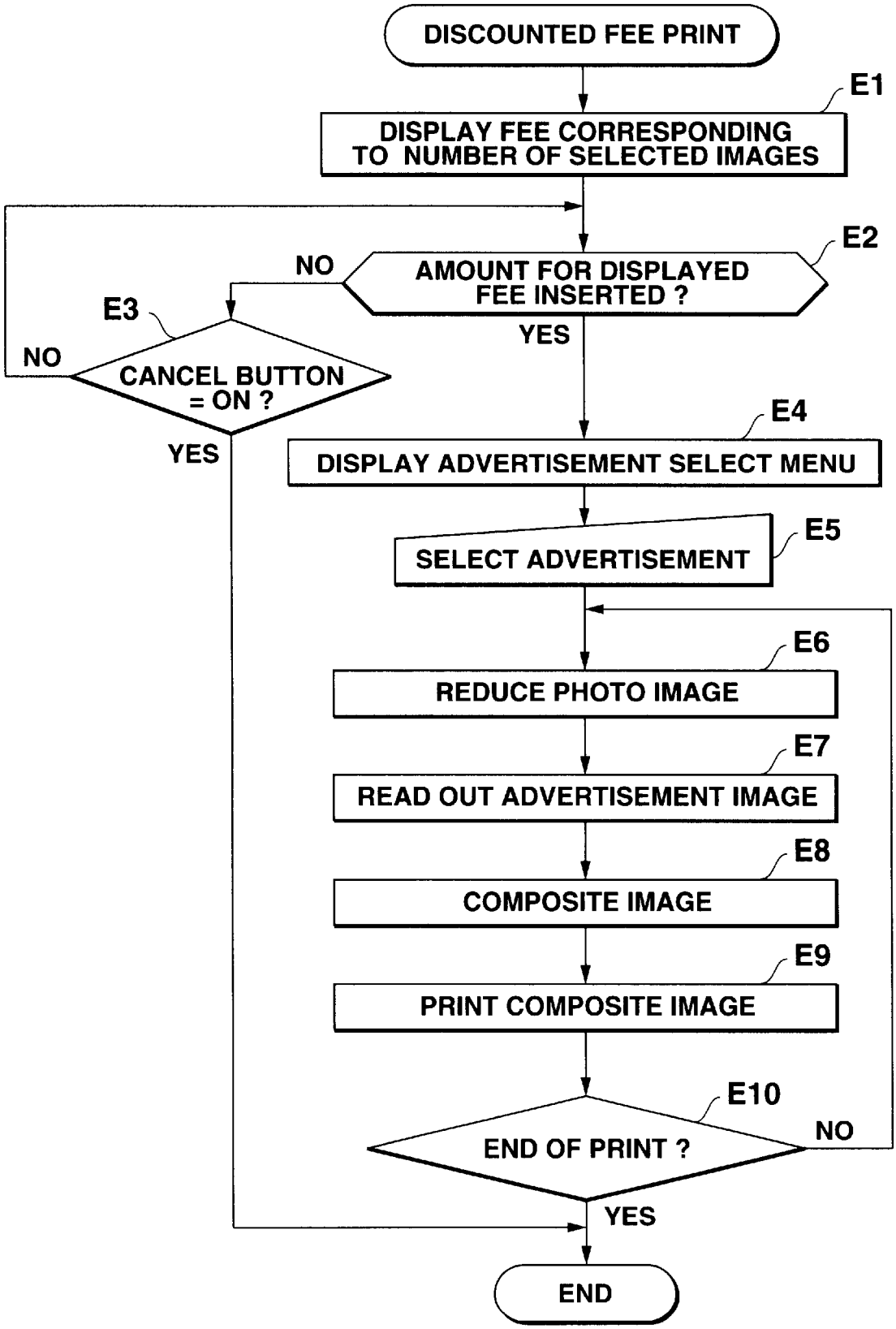
FIG. 15 is a flow chart showing a discounted print process.

FIG. 15 is a flow chart showing the discounted fee print subroutine in step C13 in FIG. 11. The controller 7 displays a fee corresponding to the number of selected images (step E1), and checks if the amount for the displayed fee is inserted from the fee insert/return port 3 (step E2). If N in step E2, the controller 7 checks if a cancel button of the console 5 is ON (step E3). If Y in step E3, the controller 7 ends this flow. If the amount for the displayed fee is inserted, the controller 7 displays an advertisement select menu (step E4).

Figure 16:
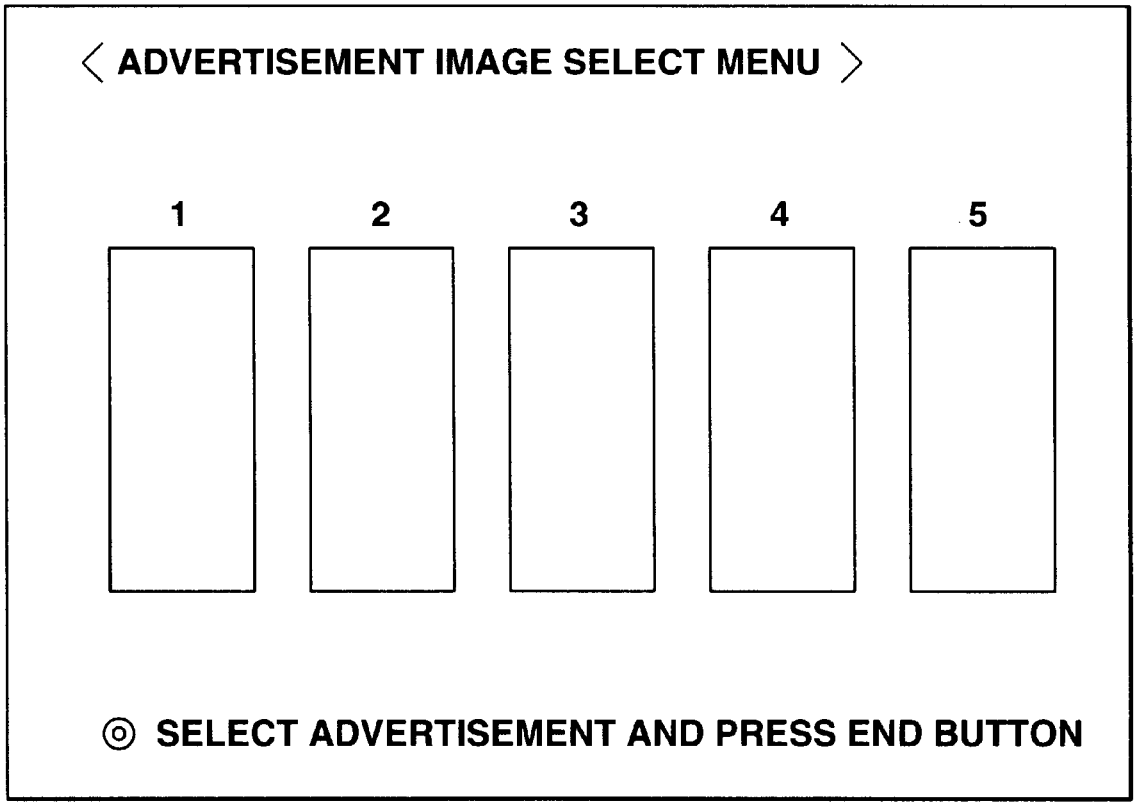
FIG. 16 shows an advertisement image select menu window displayed on the display unit.

The storage unit 15 stores data sent from the server apparatus, i.e., image data of a plurality of kinds of advertisement contents in correspondence with advertisement numbers, as shown in FIG. 7A. In the process in step E4, the controller 7 reads out the stored image data, and displays thumbnails or illustrations of corresponding advertisement information together with advertisement numbers, as shown in FIG. 16.

In the flow shown in FIG. 15, if the customer selects a given advertisement via the console 5, the controller 7 reduces a photo image to be printed which is designated by the customer (step E6). That is, the controller 7 assures a space for additionally printing the image of advertisement information outside the photo image. The controller 7 then reads out the selected image of advertisement information from the storage unit 15, and controls the image processing algorithm unit 16 to composite the two images (step E8).

The controller 7 controls the designated printer 18 to print the composite image via the printer control unit 17 (step E9). The controller 7 checks if all photo images designated by the customer have been printed (step E10). If photo images to be printed still remain, the flow returns to step E6 to repeat the processes up to step E9. If all the designated photo images have been printed, the controller 7 ends this flow.

Figure 17:
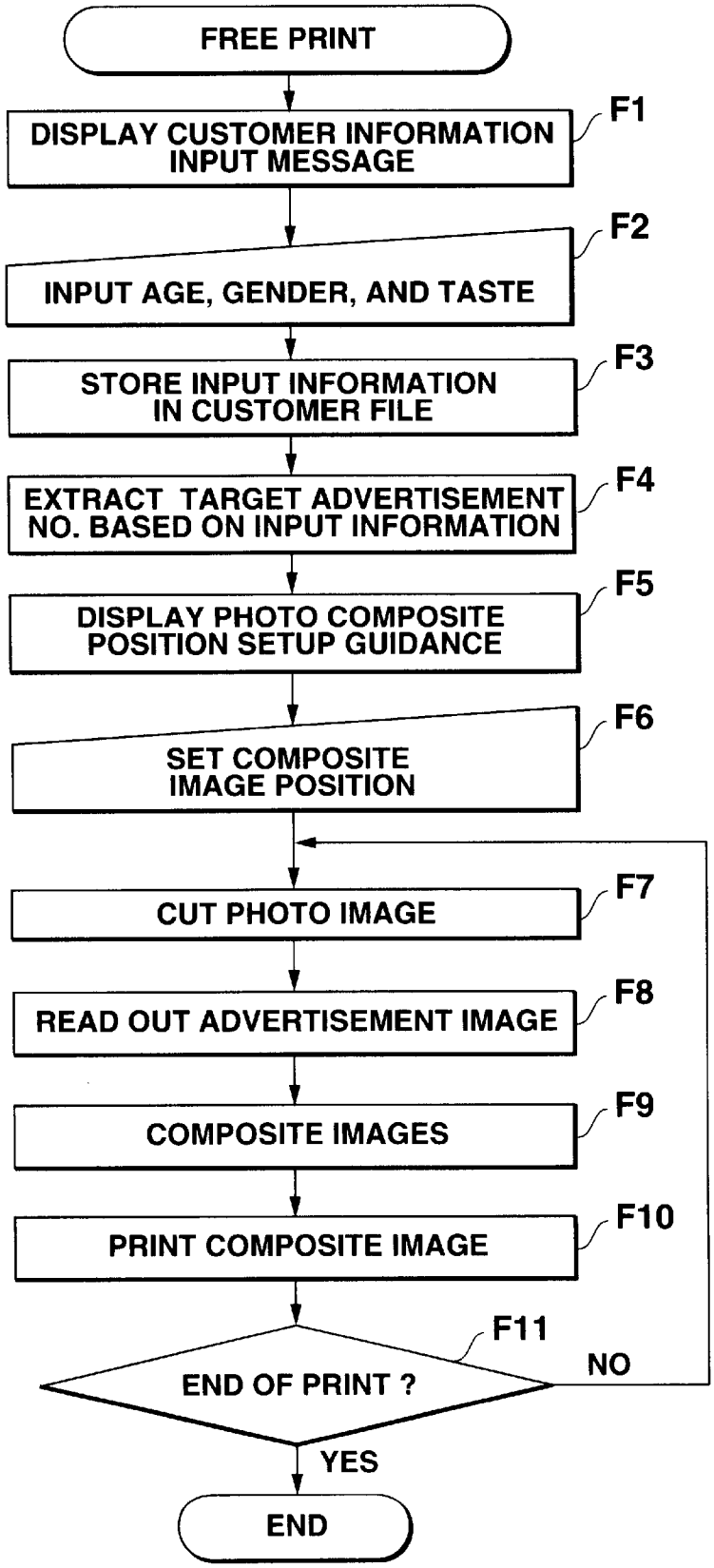
FIG. 17 is a flow chart showing a free print process.

FIG. 17 is a flow chart showing the free print subroutine in step C14 in FIG. 11. The controller 7 displays a message that prompts the customer to input customer information (step F1). The customer information includes the age, gender, and taste of the customer. If the customer inputs his or her age, gender, and taste (step F2), the controller 7 stores the input information in a customer file (customer group genre table) in the storage unit 15 (step F3).

The customer group genre table which has been sent from the server apparatus and stored in the storage unit 15 stores combinations of tastes, genders, and ages of customers in correspondence with advertisement numbers, as shown in FIG. 7B. The controller 7 looks up this table to discriminate the feature of the customer in accordance with the conditions input by that customer, and extracts a target advertisement number on the basis of the discrimination result (step F4).

Figure 18:
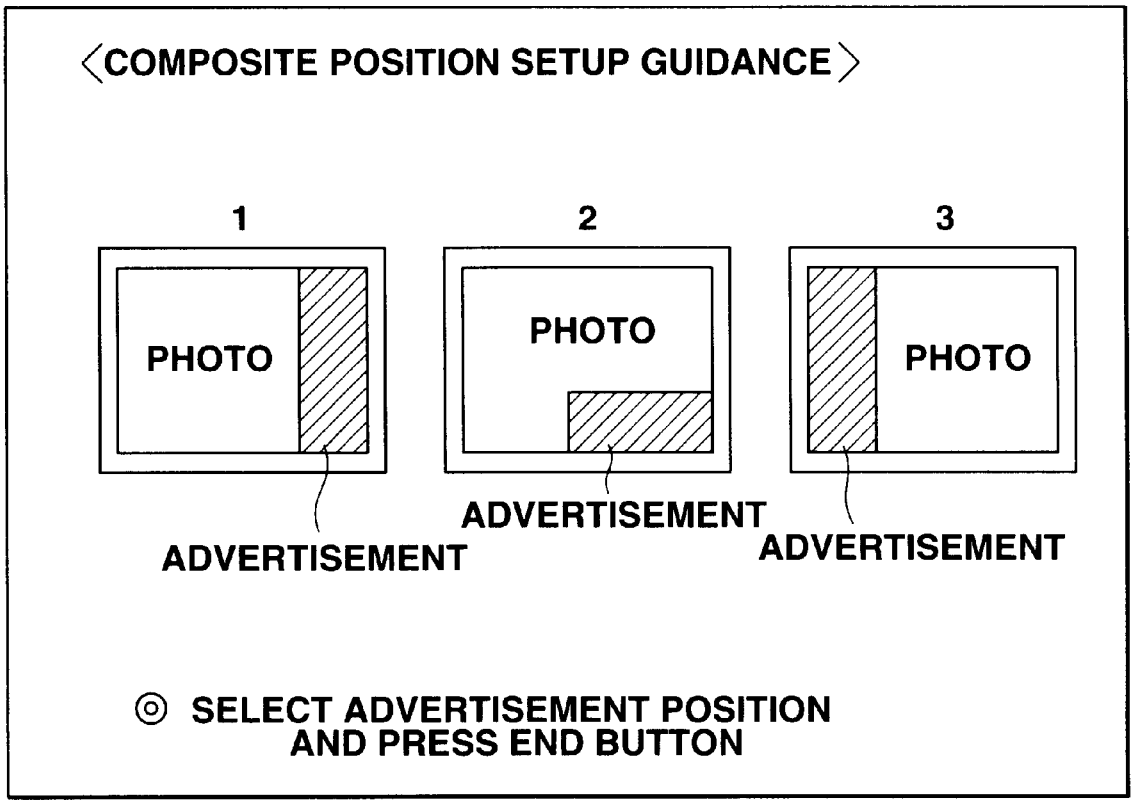
FIG. 18 shows a composite position setup guidance window displayed on the display unit.

The controller 7 displays a guidance for setting the photo composite position (step F5). FIG. 18 shows that guidance window. As shown in FIG. 18, one of three print patterns that designate.the locations of the image of advertisement information can be selected. If the customer sets a given photo composite position (step F6), the controller 7 cuts a photo image to be printed, which is designated by the customer (step F7).

More specifically, the controller 7 deletes image data of a photo image portion corresponding to the region where the image of advertisement information is going to be printed. The controller 7 then reads out the image of advertisement information to be composited from the storage unit 15 (step F8), and controls the image processing algorithm unit 16 to composite the two images (step F9). The controller 7 controls the designated printer 18 to print the composite image via the printer control unit 17 (step F10).

The controller 7 checks if all photo images designated by the customer have been printed (step F11). If photo images to be printed still remain, the flow returns to step F7 to repeat the processes up to step F10. If all the designated photo images have been printed, the controller 7 ends this flow.

That is, in the flow shown in FIG. 17, when a print fee is designated upon printing a photo image designated by the customer, and the customer inputs a pay exemption (free print) request, the designated photo image is composited with the stored image of advertisement information, and the composite image is printed. Therefore, since the advertiser bears the print fee, the customer can get free prints of photo images.

As described above, according to this embodiment, the server apparatus as the terminal management apparatus sends an image of advertisement information to a plurality of image print apparatuses as terminal apparatuses via a communication line, and each image print apparatus prints a photo image to be printed, which is designated by the customer, while adding the image of advertisement information received from the server apparatus.

Therefore, since a service person need not go to the site of each image print apparatus to input or update photo images or images of advertisement information, very easy maintenance is assured, and the maintenance cost can be greatly reduced. As a result, since the print cost can be reduced, the cost required for the advertiser who adds an image of advertisement information on a photo image the customer wants, and bears the print fee can also be reduced, thus providing inexpensive prints of photo images to customers.

On the other hand, when each image print apparatus 1 calls to acquire an image of advertisement information, a plurality of image print apparatuses 1 may issue advertisement information image requests at the same time, and the server apparatus 28 may often fail to process them. In addition, in order to receive a call from each image print apparatus 1 as needed, the communication line must always be connected, resulting in high communication cost.

However, in this embodiment, since the server apparatus 28 calls each image print apparatus 1 to establish connection, and sends an image of advertisement information, the server apparatus 28 can be prevented from failing to process requests, and the communication line need not always be connected, thus reducing the communication cost.

The server apparatus 28 stores terminal information of each terminal apparatus (image print apparatus 1) together with a plurality of kinds of images of advertisement information, and selectively sends an image of advertisement information that matches the terminal information of a given terminal apparatus to that terminal apparatus connected via a communication. Hence, an image of advertisement information that best matches a unique condition of each terminal apparatus can be sent.

When the stored image of advertisement information has changed, the server apparatus 28 specifies a terminal apparatus corresponding to the changed image of advertisement information on the basis of the stored terminal information, connects that terminal apparatus, and sends the changed image of advertisement information to the specified terminal apparatus. Therefore, since data is sent to only the terminal apparatus, the image of advertisement information of which is to be changed, the communication efficiency can be improved.

In the above embodiment, the operation of this image print system is controlled in accordance with programs installed in advance in the server apparatus 28 as the terminal management apparatus and the plurality of image print apparatuses 1 as the terminal apparatuses. Alternatively, a program may be recorded on a versatile recording medium such as a floppy disk, CD, MD, or the like, and the invention of a medium may be implemented.

Each of the terminal management apparatus (server apparatus) and terminal apparatuses (image print apparatuses) is connected to a versatile personal computer, and the program is read from the storage medium loaded into the personal computer to control the operation of this print system.

In this case, a first program may include a sequence for downloading a second program from the terminal management apparatus to each terminal apparatus via a broadcast communication.

In the above embodiment, when an image of advertisement information has been changed, the entire image of advertisement information that has been changed is sent. Alternatively, when the image of advertisement information has undergone only a small change, e.g., when a price, date, or the like has been changed, only difference data from the original image may be sent in place of the entire image data of advertisement information. In this case, higher communication efficiency and lower communication cost can be achieved.

The above embodiment has exemplified a system that prints an image of advertisement information upon printing a photo image taken by a customer using a digital camera. Also, the present invention can be applied to a system that sells telephone cards, prepaid cards of subways, and the like. For example, the present invention can be applied to the following system. That is, a plurality of terminal apparatuses that sell telephone cards are connected to a terminal management apparatus via communications, and the terminal management apparatus sends images of advertisement information to the terminal apparatuses. For example, the image of advertisement information is additionally printed on a telephone card for 1,000 yen to discount it to 900 yen or 800 yen, so that both the customers and advertisers can benefit.

In the above embodiment, the data to be sent from the server apparatus to each image print apparatus is an image of advertisement information, and the print for sale to a customer is a photo image taken by the customer. As another embodiment, images for sale to customers may be sent from the server apparatus to the image print apparatuses. For example, image information such as photo images of celebrities (movie stars, musicians, and the like), illustration images of popular animation characters, and the like may be sent.

(Modification)

A modification of the above embodiment will be explained below.

Figure 19A:
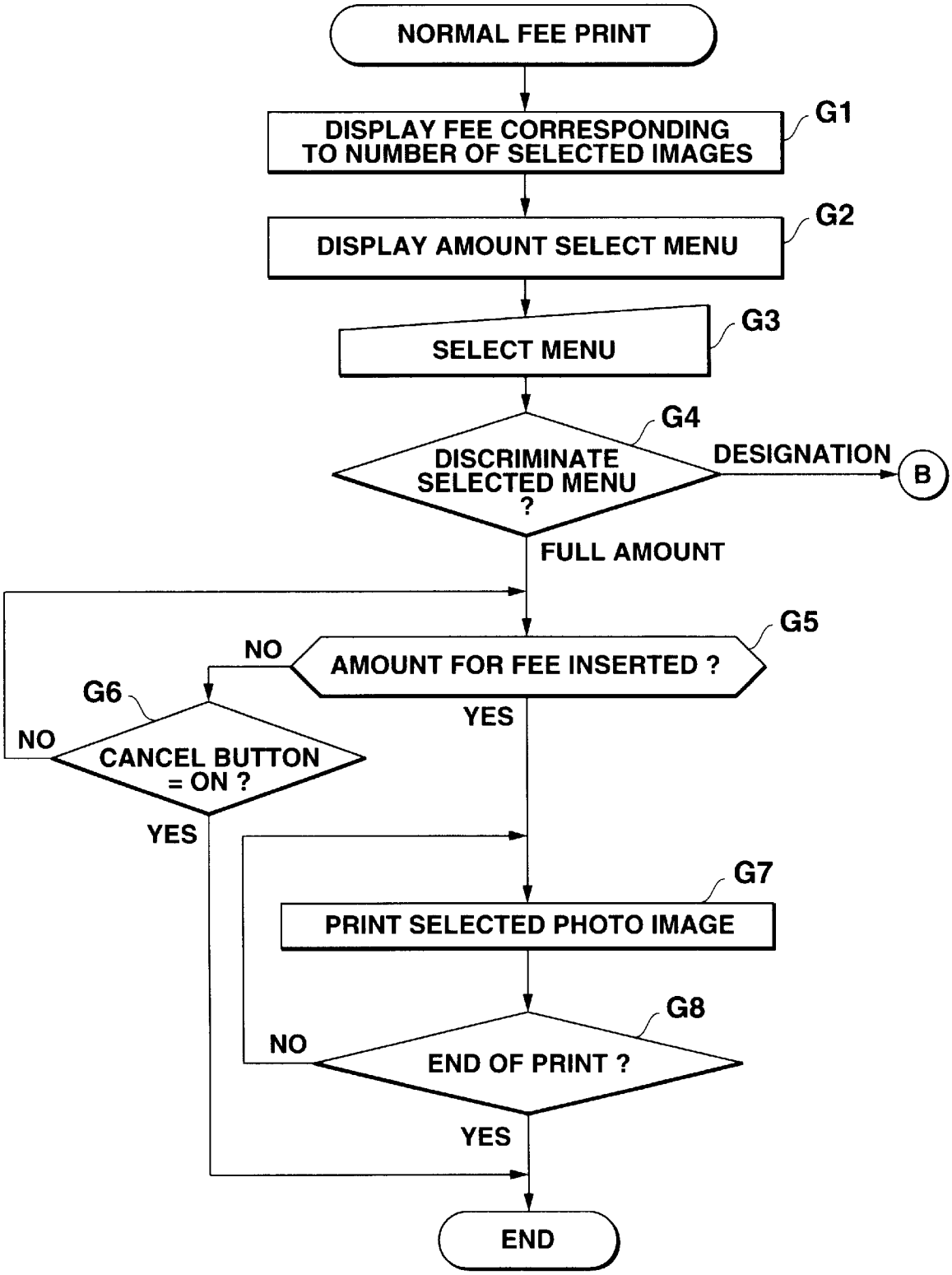
FIG. 19A is a flow chart showing a normal fee print process.
Figure 19B:
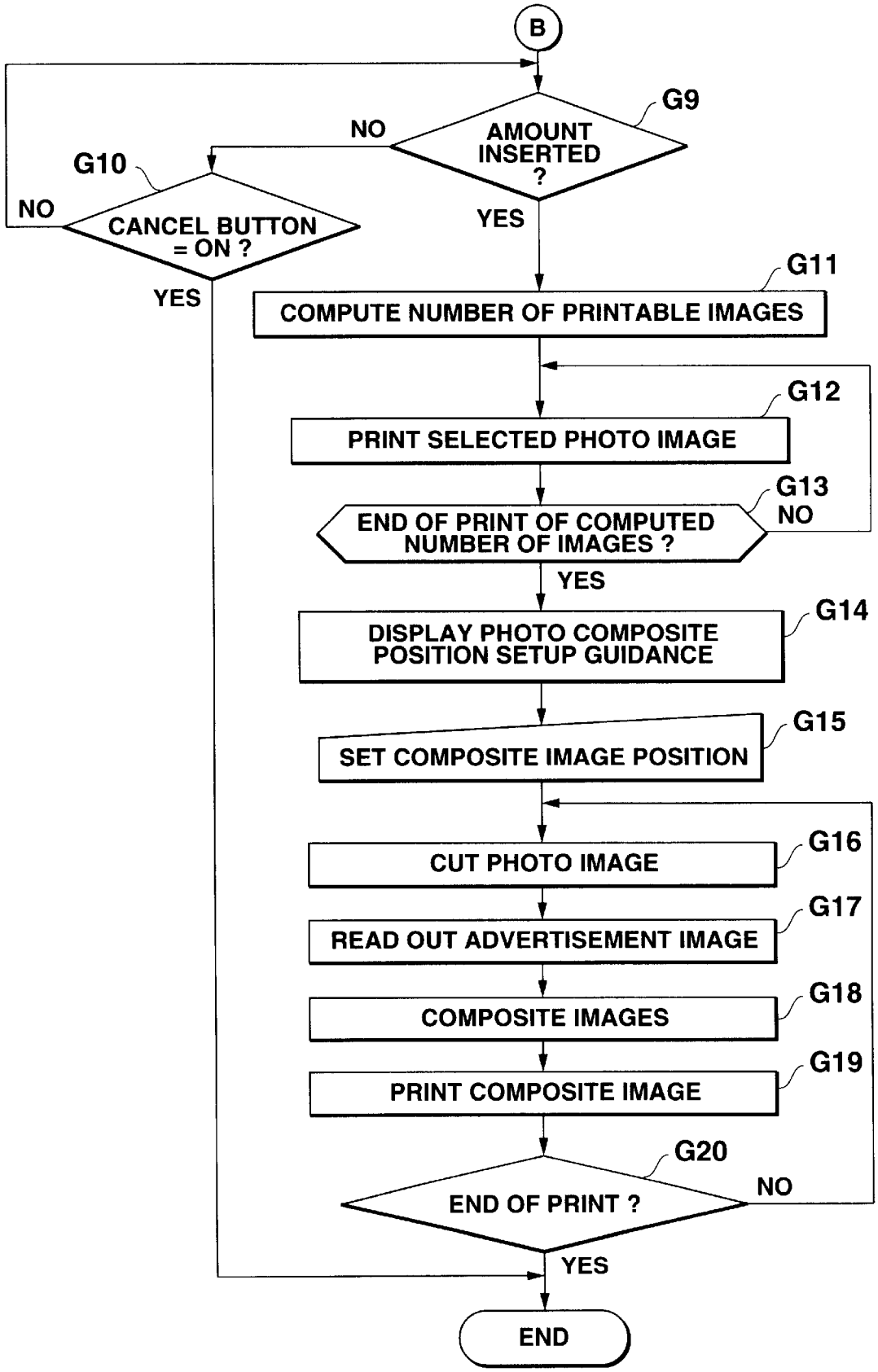
FIG. 19B is a flow chart continued from FIG. 19A.

FIGS. 19A and 19B are flow charts showing a modification of the normal fee print subroutine in step C12 shown in FIG. 11 in the above embodiment.

The controller 7 displays a fee corresponding to the number of selected images (step G1), and also an amount select menu (step G2). On this amount select menu, the customer can select whether he or she pays the full or some of the displayed amount. If the customer selects one of these menu items (step G3), the controller 7 checks if the selected menu item is a full amount or designation menu item (step G4).

If the full amount menu item is selected, the controller 7 checks if the amount for the displayed fee is inserted (step G5). While N in step G5, the controller 7 checks if a cancel button of the console 5 is ON (step G6). If Y in step G6, the controller 7 ends this flow.

If the full amount for the displayed fee has been inserted, the controller 7 prints selected photo images (step G7). The controller 7 then checks if all the selected photo images have been printed (step G8). If photo images to be printed still remain, the controller 7 repeats the print process in step G7. If all the selected photo images have been printed, the controller 7 ends this flow.

If it is determined in step G4 that the designation menu item is selected, the controller 7 checks if some amount is inserted (step G9). While N in step G9, the controller 7 checks if a cancel button of the console 5 is ON (step G10). If Y in step G10, the controller 7 ends this flow.

If the amount has been inserted, the controller 7 computes the number of images that can be printed for a normal fee (step G11). The controller 7 then prints photo images corresponding to the computed number of images of those selected by the customer (step G12). The controller 7 then checks if all the photo images corresponding to the computed number of images have been printed (step G13). If photo images to be printed still remain, the controller 7 repeats the print process in step G12.

Upon completion of all the photo images corresponding to the computed number of images, the controller 7 displays the guidance window for setting a photo composite position shown in FIG. 18 in this embodiment (step G14). If the customer designates a photo composite position (step G15), the controller 7 cuts photo images, which are not printed in step G12 due to shortage of the inserted amount, of those to be printed designated by the customer (step G16).

The controller 7 reads out an image of advertisement information to be composited from the storage unit 15 (step G17), and controls the image processing algorithm unit 16 to composite the two images (step G18). The controller 7 controls the designated printer 18 to print the composite image via the printer control unit 17 (step G19).

The controller 7 checks if all photo images designated by the customer have been printed (step G20). If photo images to be printed still remain, the flow returns to step G16 to repeat the processes up to step G19. If all the designated photo images have been printed, the controller 7 ends this flow.

Before the guidance window is displayed, the controller 7 may prompt the customer to input customer information including his or her age, gender, taste, and the like, and may select an advertisement most suitable for that customer information, as in the above embodiment.

As described above, in this modification, when the paid amount is short for the predetermined print fee required for printing a plurality of designated photo images, photo images corresponding to the short amount are printed by adding an image of advertisement information thereto.

Therefore, even when the customer cannot pay for the total of a plurality of designated photo images to be printed, photo images corresponding to the insufficient amount can undergo a free print process by adding an advertisement to these photo images, and the advertiser of the image of advertisement information to be composited with the photo images bears that print fee, thus providing inexpensive prints of photo images to the customers.

Figure 20A:
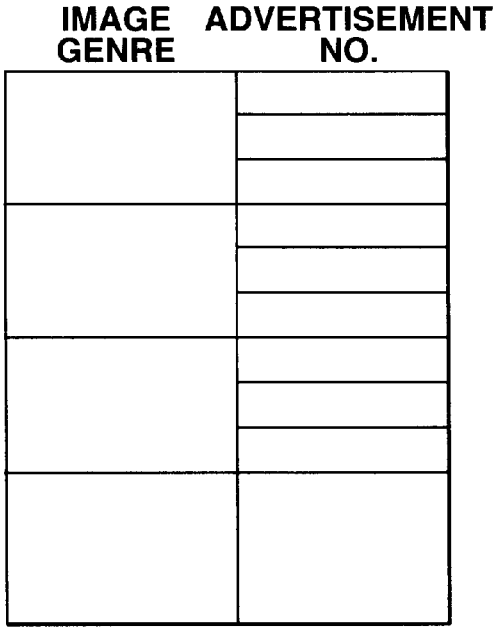
FIGS. 20A, 20B, 20C, and 20D show various tables.

In the above embodiment, the customer information including his or her age, gender, and taste is input, and an advertisement most suitable for that customer information is selected. Alternatively, the most suitable advertisement may be selected in correspondence with input customer information other than the age, gender, and taste. For example, the genre of a photo image to be printed (e.g., the photo includes a portrait of a person, landscape, animal, or the like) may be input, and an optimal advertisement may be selected by looking up a table shown in FIG. 20A. When the photo is a portrait of a person, an image of advertisement information such as cloths, drinks, automobiles, or the like may be added; when the photo is a landscape image, an image of advertisement information such as hotels, vehicles, sporting goods, or the like may be added.

Figure 20B:
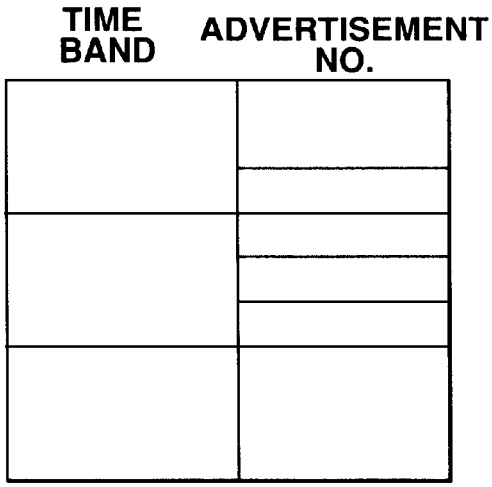

Alternatively, an optimal advertisement may be selected based on another information that allows automatic selection, independently of the information input by the customer. For example, an advertisement most suitable for the time band of the print process may be selected and added by looking up a time band table shown in FIG. 20B.

Figure 20C:
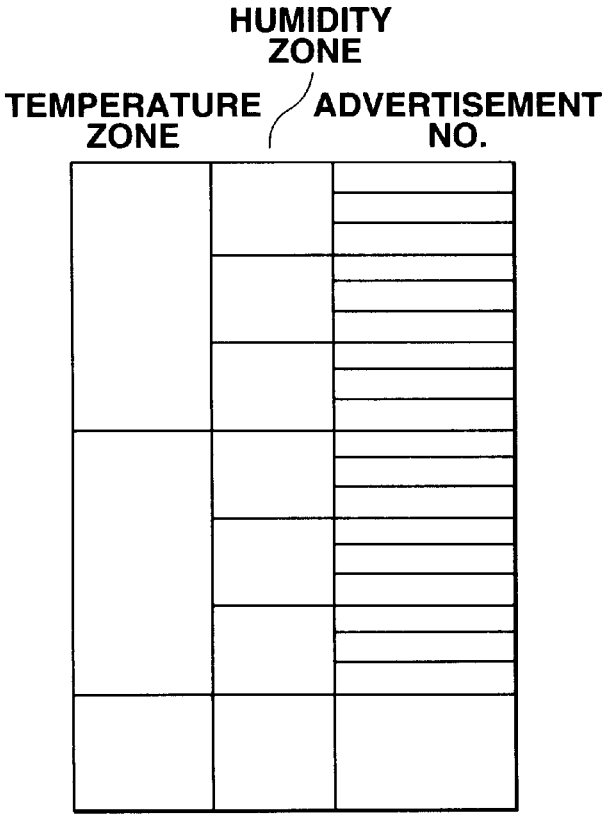

Also, for example, an advertisement most suitable for the climate may be selected and added by looking up a climate (temperature zone, humidity zone) table shown in FIG. 20C.

Figure 20D:
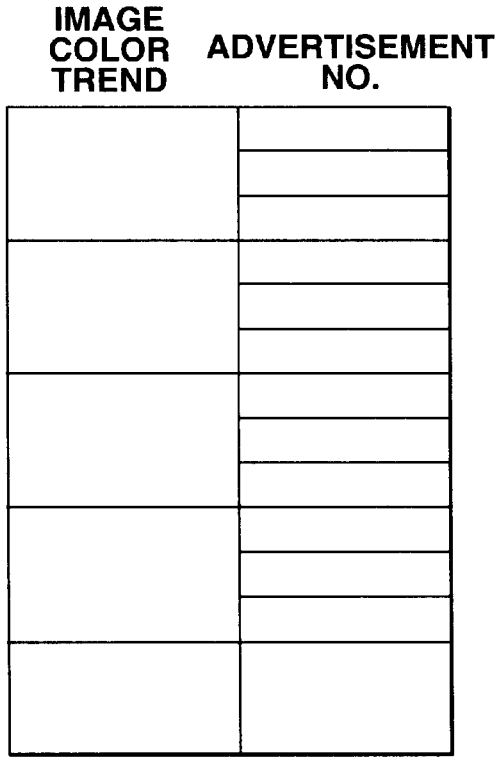

Furthermore, for example, an advertisement most suitable for an image color of a photo image to be printed may be selected and added by looking up a table that stores image color trends of photo images to be printed, as shown in FIG. 20D. In this case, an advertisement having the same image color tone as that of the photo image to be printed may be selected to match the image tone of the photo image, or an advertisement having a complementary image color tone to that of the photo image may be selected to improve the advertising effect.

In the above embodiment or modification, upon printing a photo image composited with an image of advertisement information, if there are a plurality of photo images to be printed, an identical image of advertisement information may be composited on the plurality of photo images to be printed, or different images may be composited on the respective photo images. Such print mode is selected depending on conditions such as the advertisement content, season, customer group, and the like.

Furthermore, in the above embodiment and modification, an image print apparatus which prints a photo image and sells its print has been exemplified as a customer terminal apparatus. Alternatively, the customer terminal apparatus may deal in pay information other than an image print (for example, music data, image data, or the like) as information to be output, and may sell a dubbing output (copy) of such pay information on a storage medium.

In this manner, upon dubbing such pay information on the storage medium, advertisement information can be additionally output onto that storage medium.

As a method of outputting the advertisement information, when a photo image is printed on a print medium or when pay information is dubbed onto the storage medium, the advertisement information to be output may be merely displayed on the display unit of the terminal apparatus while the customer is waiting for completion of the print or dubbing process, in place of additionally outputting it onto the medium.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A customer terminal apparatus which prints a photo image designated by a customer for pay while charging the customer a predetermined fee, comprising:

storage means for storing advertisement information provided in advance by an advertiser;

designation means for designating whether or not the advertisement information is additionally printed on the photo image;

changing means for changing the fee in accordance with the presence/absence of designation of the additional print;

discrimination means for discriminating the presence/absence of designation of the additional print of the advertisement information upon printing the photo image designated by the customer; and print control means for additionally printing the advertisement information on the designated photo image if the additional print is designated, and printing only the designated photo image if no additional print is designated.

2. An apparatus according to claim 1, wherein when the customer designates a plurality of photo images, said print control means repetitively additionally prints the advertisement information on each of the photo images.

3. An apparatus according to claim 1, wherein said storage means stores a plurality of pieces of advertisement information, and when the customer designates a plurality of photo images, said print control means additionally prints different advertisement information on each of the photo images.

4. An apparatus according to claim 1, wherein said storage means stores a plurality of pieces of advertisement information, said apparatus further comprises selection means for arbitrarily selecting desired advertisement information from the plurality of pieces of advertisement information, and said print control means additionally prints the advertisement information selected by the customer on the designated photo image.

5. A recording medium containing a computer readable program for enabling a customer terminal apparatus to print a photo image designated by a customer for pay while charging the customer a predetermined fee, said program comprising:

program code for storing advertisement information provided in advance by an advertiser;

program code for designating whether or not the advertisement information is additionally printed on the photo image;

program code for changing the fee in accordance with the presence/absence of designation of the additional print;

program code for discriminating the presence/absence of designation of the additional print of the advertisement information upon printing the photo image designated by the customer; and program code for additionally printing the advertisement information on the designated photo image if the additional print is designated, and printing only the designated photo image if no additional print is designated.

* * * * *